US005155928A

United States Patent [19]

Robertson et al.

[11] Patent Number: 5,155,928

[45] Date of Patent: Oct. 20, 1992

[54] METHOD AND TOOL FOR PERFORMING SEABED EXCAVATION

[75] Inventors: Gordon B. Robertson, York; Andrew N. Halsey, Kent, both of United Kingdom

[73] Assignee: British Gas plc, London, England

[21] Appl. No.: 747,754

[22] Filed: Aug. 19, 1991

[30] Foreign Application Priority Data

Aug. 20, 1990 [GB] United Kingdom ..... 9018257

[51] Int. Cl.[5] ..... E02F 3/88

[52] U.S. Cl. ..... 37/63; 37/65; 405/163

[58] Field of Search ..... 37/58, 62, 63, 64, 65; 405/159, 163

[56] References Cited

U.S. PATENT DOCUMENTS

| | | | |
|---|---|---|---|
| 545,762 | 9/1895 | Bates | 37/63 X |
| 2,956,354 | 10/1960 | Varner | 37/63 |
| 4,127,950 | 12/1978 | Tillinghast et al. | 37/62 |
| 4,327,507 | 5/1982 | Volbeda | 37/63 X |
| 4,479,741 | 10/1984 | Berti et al. | 37/63 X |

FOREIGN PATENT DOCUMENTS

| | | | |
|---|---|---|---|
| 62-111029 | 11/1985 | Japan . | |
| 7408623 | 6/1974 | Netherlands . | |
| 223897 | 3/1942 | Switzerland . | |
| 1465526 | 3/1989 | U.S.S.R. | 37/65 |

*Primary Examiner*—Randolph A. Reese
*Assistant Examiner*—Arlen L. Olsen
*Attorney, Agent, or Firm*—Larson and Taylor

[57] ABSTRACT

For excavation of a clay seabed, particularly in a coffer dam to expose a buried pipeline, a minimum of three water nozzles producing water jets and the associated effects 16, 17 and 18 are used. The nozzles are mounted on a disc 12 which can move horizontally and vertically and which rotates in a horizontal plane. The effect 18 (if operated alone) would produce a trench 22 having sloping sides. The two effects 16, 17 enable a trench having vertical sides to be cut and enable the disc 12 to be moved downwardly until obstructed by the base of the trench. The three nozzles are equiangularly spaced about the axis. The rotation of the disc 12 makes the effect of the nozzles possible.

20 Claims, 3 Drawing Sheets

FIG. 1.
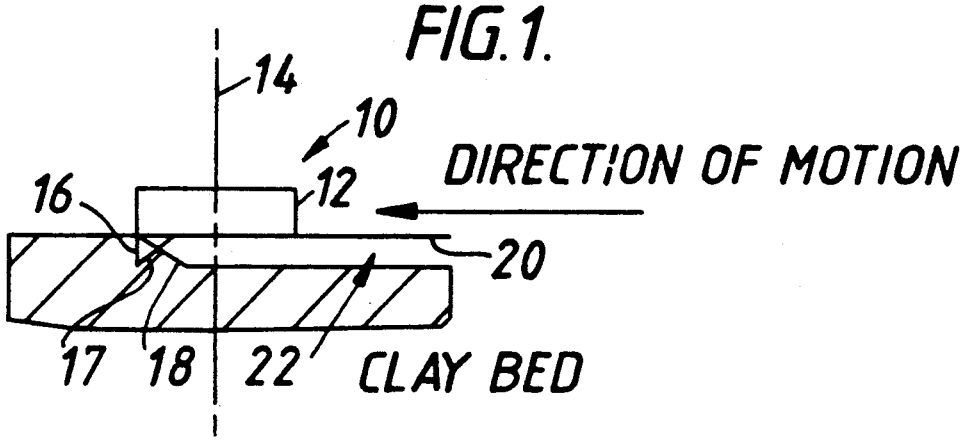
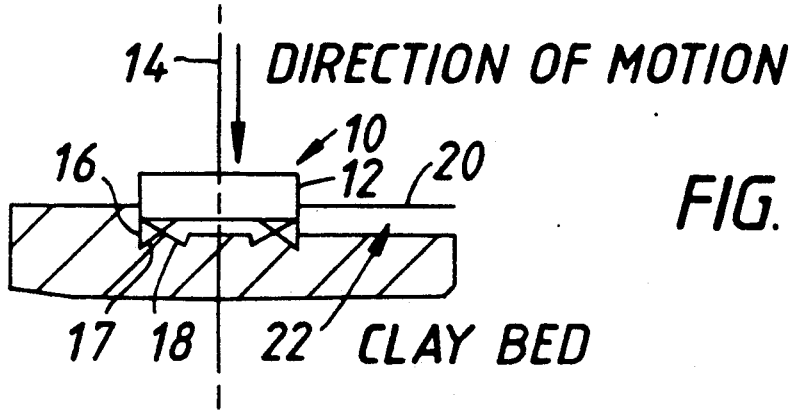
FIG. 2.
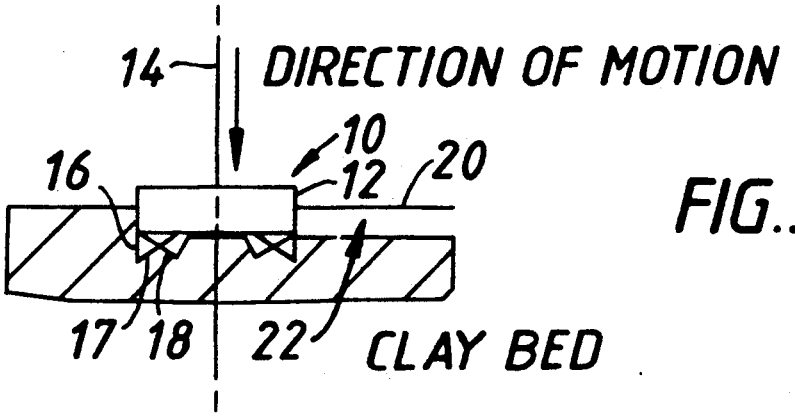
FIG. 3.

FIG.6.
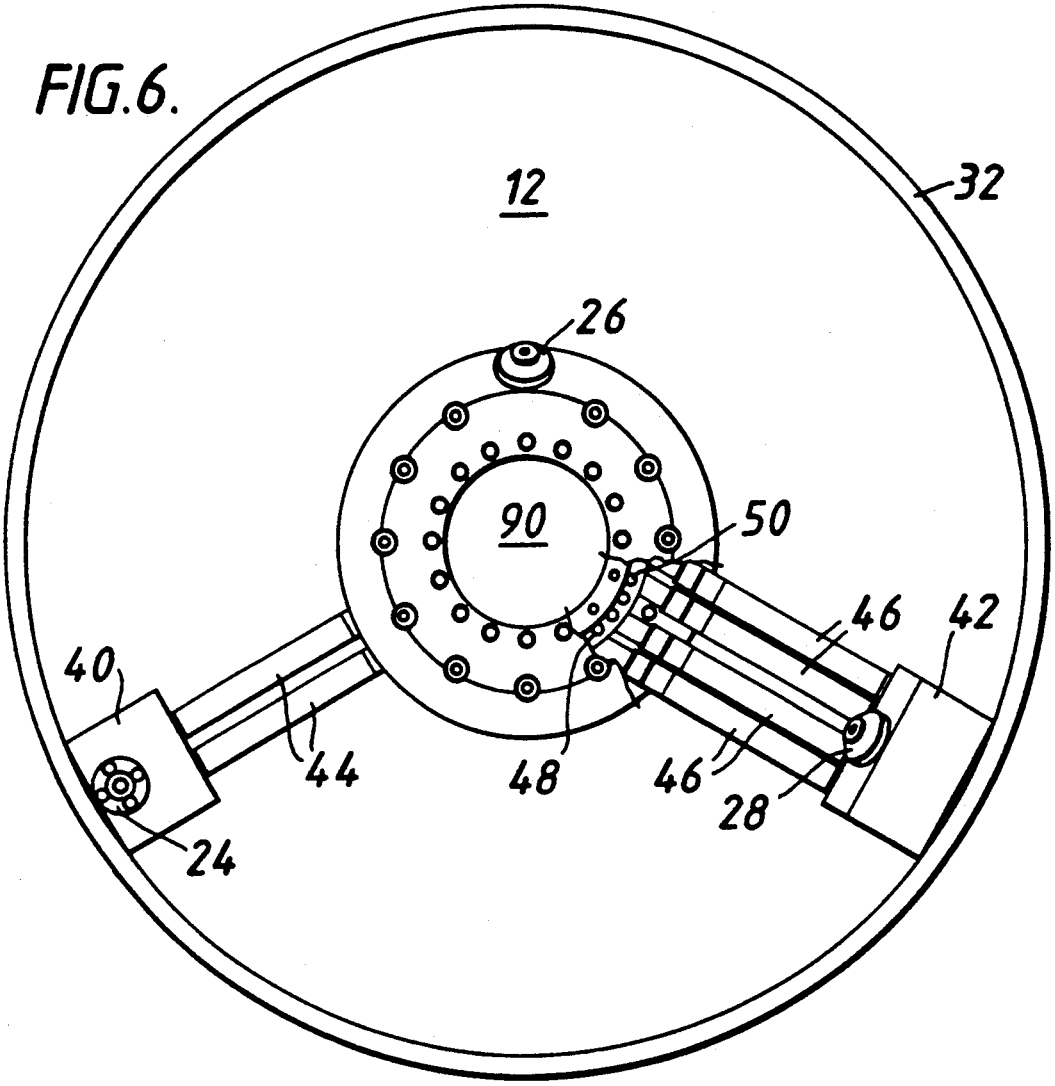
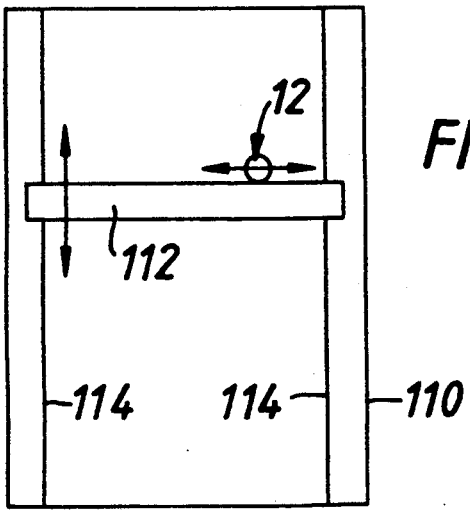
FIG.7.

METHOD AND TOOL FOR PERFORMING SEABED EXCAVATION

FIELD OF THE INVENTION

The invention relates to methods of performing seabed excavation and to a tool for performing the method.

SUMMARY OF THE INVENTION

The method is particularly suitable, for example, for excavating the seabed beneath a frame to enable isolation valves to be installed or in a coffer dam in order to expose a buried pipeline. In these instances the seabed is more or less horizontal. However, the method has other applications including those in which the seabed in non-horizontal, so that the array of water jet nozzles has to be operated in a plane other than horizontal. For that reason, the term 'depth of cutting' as used herein is not to be limited to a vertical direction.

According to the invention, a method of performing seabed excavation comprises rotating an array of a minimum of three water nozzles about a axis of rotation and moving said axis parallel to itself in at least one direction, the effect of the jet from a first nozzle which lies nearer to said axis intersecting at a first depth of cutting the effect of the jet from a second nozzle, which lies further from the axis, the third nozzle being further from said axis than said first nozzle and the effect of its jet intersecting at a second depth of cutting less than said first depth, the effect of the jet from said first nozzle, and removing debris from the result of action of said jets.

According to the invention, a tool for performing the method comprises a rotatable assembly comprising a generally planar member supported by a hub, the plane of the member being at right angles to the rotational axis of the rotatable assembly and the hub forming an inlet for debris, the tool being movable parallel to the said axis in at least one direction, and an array of a minimum of three water nozzles mounted on said planar member, the effect of the jet from a first nozzle which lies nearer to said axis intersecting the effect of the jet from a second nozzle, which lies further said axis, at a first depth of cutting, the third nozzle being further from said axis than said first nozzle and the effect of its jet intersecting the effect of the jet from the first nozzle at a second depth of cutting less than said first depth, and a jet pump in a conduit for removing debris through said inlet from the result of action of said jets.

BRIEF DESCRIPTION OF THE DRAWINGS

An example of the method and an example of a tool for use in performing the method will now be described with reference to the accompanying drawings in which:

FIGS. 1 to 3 show modes of cutting the seabed using the tool in the course of excavating the seabed using the method, FIG. 6 is a view, looking upwards, of the tool shown in FIG. 5, and FIG. 7 is a schematic plan view of the operation of the present invention within a coffer dam.

DETAILED DESCRIPTION OF THE PREFERRED EMBODIMENTS

Figure 4:
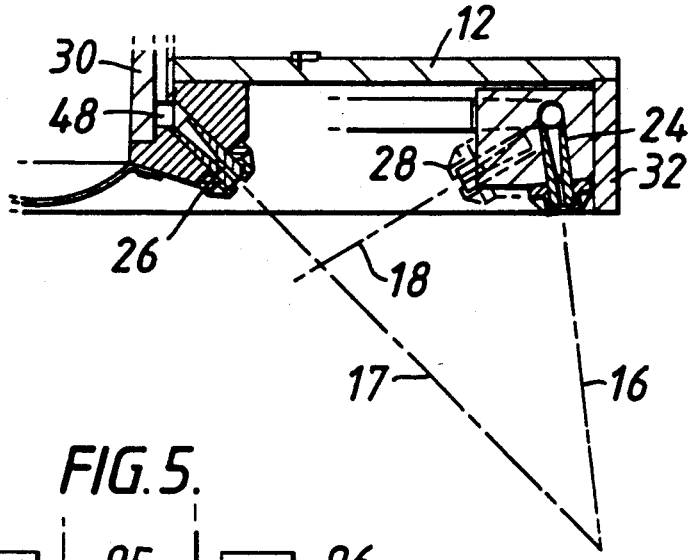
FIG. 4 is a scrap vertical section through an array of nozzles and part of a disc supported on a hub on which the array is mounted.
Figure 5:
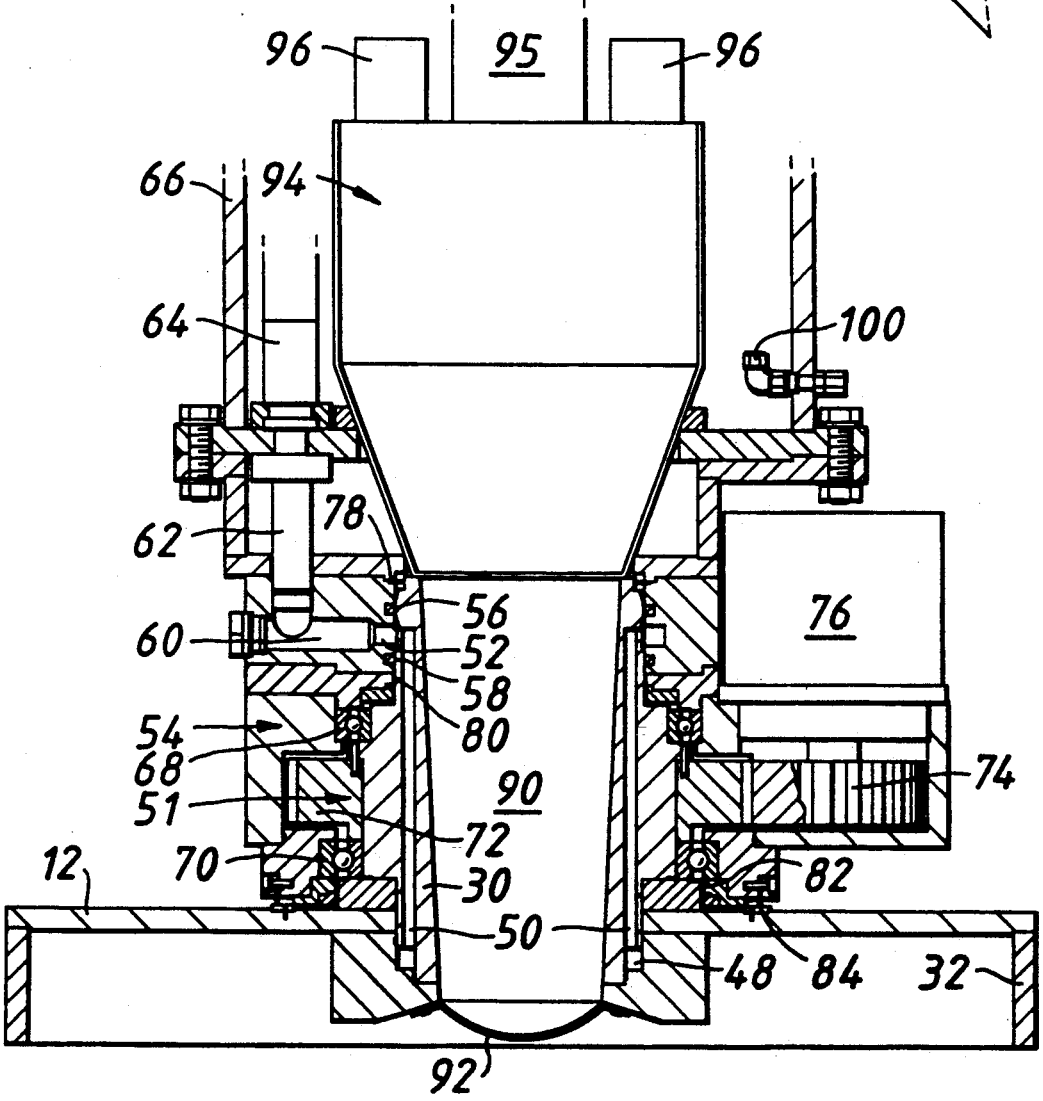
FIG. 5 is a vertical diametric section through the tool showing the disc and hub shown in FIG. 4 but not showing the array of nozzles.

FIGS. 1–3 show modes of operation of the tool 10 shown in FIGS. 4–6. The tool 10 consists of an array of three nozzles mounted on a circular disc 12. The disc 12 is rotatable about an axis 14 normal to the disc 12. The tool 10 is movable from right to left as shown in the FIGS. (and back from left to right). The tool 10 is also movable in both directions transversely to the plane of the FIGS. and can also move up and down in the plane of the FIGS. as shown.

Each nozzle emits a jet of high pressure (eg 3000 pounds per square inch) water and the effects of these jets are shown by three lines 16, 17, 18 in the figures. The tool 10 is designed to cut and excavate a seabed consisting of clay, for example the boulder clay encountered in the Morecambe Bay zone of the North Sea. Such excavation is required to enable buried pipelines to be exposed, for example, within a coffer dam.

FIG. 1 shows the mode of operation when the tool 10 advances at a constant height above the seabed 20. A shallow trench 22 is cut out. The sides of the trench are vertical owing to the effect 16, together with the effect 17, which enables the segment of clay to be detached. The nozzle producing the effect 16 is angled very slightly to point outside the periphery of the disc 12 as described below.

If the array consisted of only the nozzle producing the effect 18, the sides of the trench would be sloping, at the angle of the effect 18. The forward motion of the disc 12 would repeatedly strip off sections of clay at that angle thus producing the trench 22.

By adding the two nozzles producing the effects 16 and 17 the disc 12 has the ability to cut downwardly until it is obstructed by the base of the trench 22 as shown in FIGS. 3. FIG. 2 shows an intermediate stage.

The disc 12 can thus cut clay right up to a vertical boundary in any plane. Further progress in cutting, now at the new depth of cutting shown in FIG. 3, can be made by advancing the disc 12 from left to right back along the route of the trench 22, if desired. Of course, the whole of an area (for example the rectangular area within a coffer dam) can be cut at the depth of cutting shown in FIG. 1 before any sinking of the disc 12 is attempted. Then, a new first trench is cut from the position shown in FIG. 3 and, using cuts at the same depth, the whole area is again cut. Thus, progressively, the whole area may be excavated to any depth.

FIG. 4 shows the three nozzles 24, 26, 28 producing the effects 16, 17, 18 just referred to. The nozzles 24, 26 28 form an array mounted on the disc 12 supported by a hub 30, part of which is shown in FIG. 4 but which is better shown in FIG. 5. The disc 12 has a downwardly extending peripheral circular flange 32. The angle of inclination of the nozzle 24 produces an effect 16 which intersects with the effect 17 from the nozzle 26 at a point close to or on the notional cylinder, the continuation downwardly of the flange 32. This means the effect 16 excavates a vertical wall which just clears the flange 32.

FIGS. 1 to 4 shown the lines 16–18 or the three nozzles 24, 26 and 28 in an idealised manner, all lying in the same vertical plane. In fact, the three nozzles are distributed about the centre of the disc 12 at 120 degree spacing, as shown in FIG. 6. Each nozzle 24, 28 is mounted in its own manifold 40, 42, respectively, and is fed by tubes 44, 46, respectively, from a water distribution annulus 48 (FIG. 5). The nozzle 26 is mounted on the hub 30 and communicates directly with the water distribution annulus 48 (FIG. 4). The effect of rotation of the disc 12 makes the effects of the nozzles as explained with respect to FIGS. 1 to 4.

The water distribution annulus 48 is fed by a plurality of drillings 50 which extend longitudinally within the wall of the hub 30, which with the disc 12 forms the rotatable assembly 51 of the tool. The drillings 50 are fed from a water feed annulus 52 machined in the non-rotatable assembly 54. High pressure water seals 56, 58 are positioned in the non-rotatably assembly 54 on each side of the water feed annulus 52. The water reaches the feed annulus 52 through three cross-drillings 60 in the non-rotatable assembly 54, three water transfer tubes 62 and three hoses 64 extending downwardly within a tubular mast 66. The water fed to the nozzles 24, 26, 28 is supplied from a point remote from the vicinity of cutting effected by the nozzles 24, 26, 28.

The hub 30 is rotatably mounted in two sets of ball bearings 68, 70 and carries a gear 72 which meshes with another gear 74 driven by a hydraulic motor 76.

A brush seal 78 engages the upper end of the hub 30. A lip seal 80 engages the hub 30 beneath the high pressure seals 56, 58. A lip seal 82 and a brush seal 84 are also provided.

Debris is removed from the seabed, resulting from the effects of the jets 16, 17, 18 upwards through the inlet 90 formed by the bore of the hub 30. The entrance to the inlet has a coarse mesh grid 92 placed over it. Upflow through the inlet 90 is produced by a jet pump located at 94 and the debris is ejected through a conduit 95 leading to a remote point of disposal. Water flow hoses for the jet pum are connected at 96.

A supply of hydraulic fluid (and a return path not shown) for the hydraulic motor 76 is fed by a hose through the centre of the mast 66 to the bulkhead connector 100. From there another hose connects with the motor 76.

In this example, the tool is part of an arrangement for excavating the seabed within a coffer dam 110 (FIG. 7). The apparatus shown in FIG. 5 includes the lower end of a mast 66 which is mounted on a gantry 112 movable along the coffer dam 110 on a pair of rails 114. The mast 66 is mounted so as to be traversable along the gantry 112 and also so as to be movable towards and away from the seabed.

Although in this example the seabed is considered to be horizontal, in other applications the array of nozzles 24, 26 and 28 may be operated in a plane which is other than horizontal, for example where a sloping seabed is being excavated or where a vertical wall is to be excavated. The depth of cutting is not limited to a vertical direction, for that reason.

Further nozzles can be used in modifications. For example, further nozzles on the same pitch circle as the nozzle 28 can be used. This will have the effect of deepening the trench 22 but reducing the rate of advance. Further nozzles corresponding to the nozzles 24 and 26 can be used but in all cases more water power must be provided or else, or in addition, some control of the period during which the nozzles are 'on' will be needed.

The mast 66 described above may, in a modification, be mounted on a frame instead of being mounted in a coffer dam. Such an arrangement is suitable for digging foundations for sub-sea isolation valves. The mast would be movable along the frame and also movable across the frame as well as being movable vertically. In another modification the tool may be mounted on a tracked sub-sea vehicle. For example, the vehicle may have a plunge arm on which the tool is mounted.

In all such modifications and in the example described above with reference to the drawings the tool can be remotely operable from a surface vessel or platform.

We claim:

1. A method for performing seabed excavation using a tool having an array rotatable about a longitudinal axis comprising the steps of:

rotating the array about the longitudinal axis of rotation, the array including at least a first nozzle which is radially closer to the axis than a second nozzle and a third nozzle;

directing the first nozzle and the second nozzle longitudinally away from the array such that respective jets of water issuing from the first nozzle and the second nozzle form respective first and second cutting planes as the array is rotated which first and second cutting planes intersect at a first depth of circumferential cutting of the seabed longitudinally away from the array;

directing a third nozzle of the array such that a jet issuing from the third nozzle forms a third cutting plane as the array is rotated which intersects the first cutting plane at a second depth of circumferential cutting of the seabed longitudinally away from the array and of less depth than the first depth;

moving the array longitudinally toward the seabed such that the jets of water cut the seabed; and removing debris cut from the seabed by the jets as the array is rotated.

2. A method for performing excavation as claimed in claim 1 wherein the array includes an inlet at a center thereof, and wherein said removing step includes the step of drawing the debris cut from the seabed into the inlet.

3. A method for performing excavation as claimed in claim 2 wherein the seabed being excavated is contained between a coffer dam having a longitudinal dam axis, and wherein said moving step also includes the steps of moving the array longitudinally and laterally of the longitudinal dam axis of the dam.

4. A method for performing excavation as claimed in claim 3 said moving step includes the moving a central portion of the array into engagement with the seabed, and the further step of moving the array at right angles to the longitudinal axis of rotation.

5. A method for performing excavation as claimed in claim 4 wherein said directing step of the first and second nozzles directs these nozzles so that the first depth of circumferential cutting is positioned laterally of the longitudinal axis beyond the array such that the array is laterally within the first depth of circumferential cutting.

6. A method for performing excavation as claimed in claim 1 wherein the seabed being excavated is contained between a coffer dam having a longitudinal dam axis, and wherein said moving step also includes the steps of moving the array longitudinally and laterally of the longitudinal dam axis of the dam.

7. A method for performing excavation as claimed in claim 1 said moving step includes the moving a central portion of the array into engagement with the seabed, and the further step of moving the array at right angles to the longitudinal axis of rotation.

8. A method for performing excavation as claimed in claim 1 wherein said directing step of the first and second nozzles directs these nozzles so that the first depth of circumferential cutting is positioned laterally of the longitudinal axis beyond the array such that the array is laterally within the first depth of circumferential cutting.

9. A seabed excavation tool comprising:

a non-rotatable assembly having an elongate conduit with a longitudinal axis and being movable at least along the longitudial axis toward the seabed;

a rotatable assembly which is mounted to said non-rotatable assembly for rotation about an axis of rotation parallel to the longitudinal axis and including a hub including a central inlet for debris, said central inlet being in fluid communication with said conduit of said non-rotatable assembly, a generally planar member supported by said hub and having a plane which is at right angles to the axis of rotation, and an array mounted on said planar member and including at least a first nozzle which is radially closer to the rotational axis than a second nozzle and a third nozzle, with said first nozzle and said second nozzle of said array directed longitudinally away from said array such that respective jets of water issuing from said first nozzle and said second nozzle form respective first and second cutting planes as said array is rotated which first and second cutting planes intersect at a first depth of circumferential cutting of the seabed longitudinally away from said array, and such that a jet issuing from said third nozzle forms a third cutting plane as the array is rotated which intersects the first cutting plane at a second depth of circumferentially cutting of the seabed longitudinally away from said array and of less depth than the first depth;

a jet pump means in said conduit for removing debris cut from the seabed by the jets of water from said nozzles; and a rotation means for rotating said rotatable assembly about the axis of rotation relative to said non-rotatable assembly.

10. A seabed excavation tool as claimed in claim 9 wherein said hub includes a water distribution annulus, and said non-rotatable assembly includes a water feed annulus; further including a plurality of drillings extending longitudinally through said hub and in fluid communication with said water feed annulus, respective tubes connecting said water distribution annulus and an associated respective said nozzle, and respective high pressure seals between said hub and said non-rotatable assembly on either side of said water distribution annulus.

11. A seabed excavation tool as claimed in claim 10 wherein said nozzles are spaced on said array at 120 degrees intervals about the axis of rotation.

12. A seabed excavation tool as claimed in claim 11 wherein said array is a disc mounted at said hub.

13. A seabed excavation tool as claimed in claim 12 and further including bearings for rotatably mounting said hub to said non-rotatable assembly; wherein said rotation means includes a gear about said hub, a motor mounted to said non-rotatable assembly, and an output gear from said motor which engages said gear about said hub such that said motor rotates said hub.

14. A seabed excavation tool as claimed in claim 13 wherein said hub includes a cover grid for said central inlet.

15. A seabed excavation tool as claimed in claim 14 wherein said first depth of circumferential cutting is positioned laterally of the longitudinal axis beyond aid array such that said array is laterally within said first depth of circumferential cutting.

16. A seabed excavation tool as claimed in claim 9 wherein said nozzles are spaced on said array at 120 degrees intervals about the axis of rotation.

17. A seabed excavation tool as claimed in claim 9 wherein said array is a disc mounted to said hub.

18. A seabed excavation tool as claimed in claim 9 and further including bearings for rotatably mounting said hub to said non-rotatable assembly; wherein said rotation means includes a gear about said hub, a motor mounted to said non-rotatable assembly, and an output gear from said motor which engages said gear about said hub such that said motor rotates said hub.

19. A seabed excavation tool as claimed in claim 9 wherein said hub includes a cover grid for said central inlet.

20. A seabed excavation tool as claimed in claim 9 wherein said first depth of circumferential cutting is positioned laterally of the longitudinal axis beyond said array such that said array is laterally within said first depth of circumferential cutting.

* * * * *